US005174482A

United States Patent [19]

Rogers et al.

[11] Patent Number: 5,174,482

[45] Date of Patent: Dec. 29, 1992

[54] MAGAZINE HOLSTER

[75] Inventors: William H. Rogers; Norman E. Clifton, Jr., both of Jacksonville, Fla.

[73] Assignee: Safariland Ltd., Inc., Ontario, Calif.

[21] Appl. No.: 672,678

[22] Filed: Mar. 20, 1991

[51] Int. Cl.[5] ..... F42B 39/00

[52] U.S. Cl. ..... 224/239; 224/196; 224/240; 224/245; 224/253; 224/914; 42/89; 221/185; 221/279

[58] Field of Search ..... 224/239, 236, 240, 245, 224/196, 253, 242, 246, 236, 252, 231, 228, 224-226, 904, 911, 912, 914; 42/87-89; 221/185, 279, 198, 226, 56, 58, 59; 206/3; 264/257; 220/93; 150/127, 129, 130; 190/124, 125

[56] References Cited

U.S. PATENT DOCUMENTS

| | | | |
|---|---|---|---|
| 162,481 | 4/1875 | Lee | 221/185 |
| 225,169 | 3/1880 | Sauerbrey | 224/196 |
| 1,671,285 | 5/1928 | Hanna | 221/279 X |
| 2,216,476 | 10/1940 | Mutz | 221/198 |
| 2,902,196 | 9/1959 | Gray | 221/185 X |
| 3,113,796 | 12/1963 | Neil | 224/239 X |
| 3,272,411 | 9/1966 | Hanson | 224/253 |
| 3,575,226 | 4/1971 | Chapman | 150/129 X |
| 3,696,915 | 10/1972 | Douglas | 220/93 X |
| 4,272,903 | 6/1981 | Griffis | 42/89 |
| 4,614,052 | 9/1986 | Brown et al. | 42/87 |
| 4,688,344 | 8/1987 | Kim | 42/88 X |
| 4,757,894 | 7/1988 | Schreckenstein | 206/3 |
| 5,048,720 | 9/1991 | Hoke | 221/198 |

FOREIGN PATENT DOCUMENTS

| | | | |
|---|---|---|---|
| 0152901 | 7/1904 | Fed. Rep. of Germany | 224/245 |

*Primary Examiner*—Henry J. Recla
*Assistant Examiner*—Casey Jacyna
*Attorney, Agent, or Firm*—Arthur G. Yeager

[57] ABSTRACT

A holster for a magazine of an automatic pistol, the magazine being slid into a carrier box that slides longitudinally in the elongated rectangular pouch with a flexible flap cover having a snap fastener to attach the cover to the pouch; the carrier being biased by a coil spring urging the carrier upward to expose the magazine which is contacted by the cover to prevent the magazine from removal until it is handled by the wearer.

20 Claims, 3 Drawing Sheets

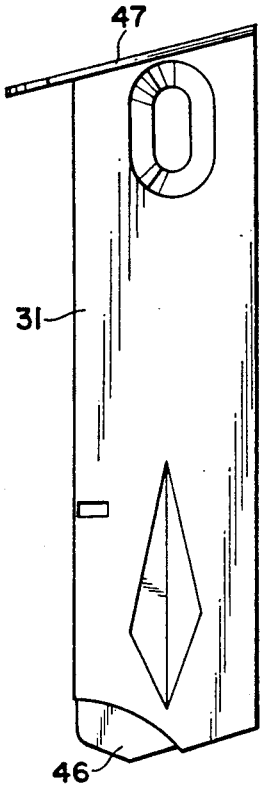
FIG 5
PRIOR ART
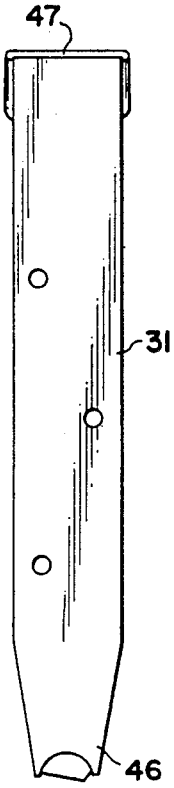
FIG 6
PRIOR ART
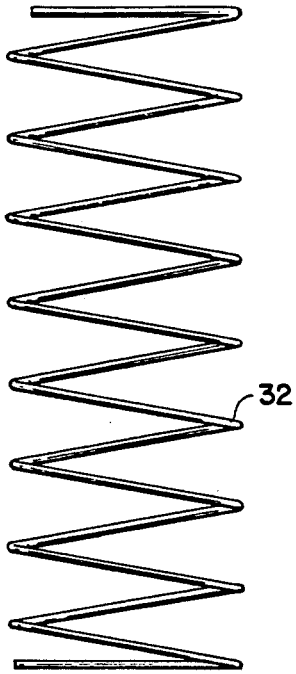
FIG 10
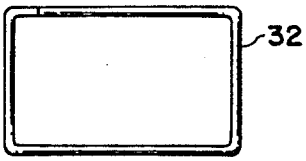
FIG 11
FIG 12
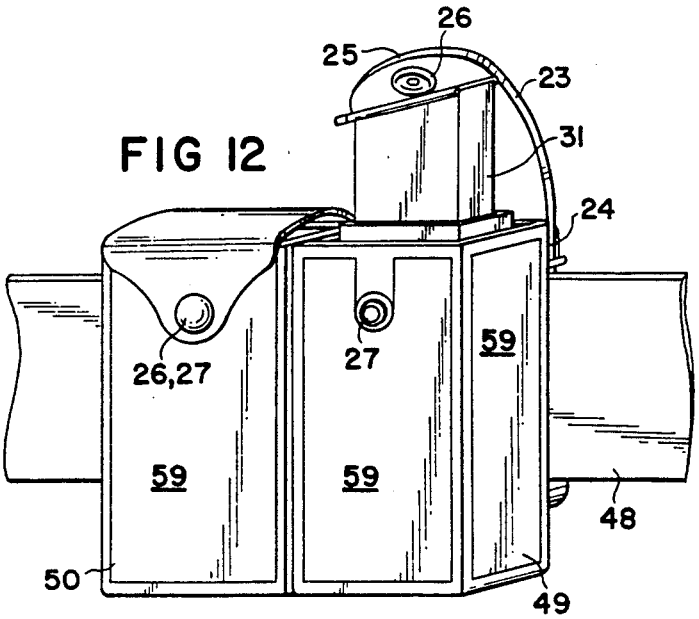

MAGAZINE HOLSTER

BACKGROUND OF THE INVENTION

Persons armed with pistols, revolvers, rifles, carbines, or the like such as the police or the military usually find it desirable to carry extra ammunition, preferably in a clip which can quickly be inserted into the firearm when it must be reloaded. It has become convenient to carry one or more clips in a special clip holster worn on a waist belt. Typical of those used for revolver clips are reloaders shown in U.S. Pat. Nos. 4,272,903 to Griffis and U.S. Pat. No. 4,408,707 to Rogers. One type of cartridge pouch for automatic pistol clips or magazines is shown in U.S. Pat. No. 855,098 to Cutts. A more recent military type (patent reference, if any, is unknown) is simply a canvas or leather pouch carrying two magazines in a generally vertical disposition and covered with a snap fastening flap. It has become preferable to have a holster for magazines of automatic or semiautomatic pistols which allows for a speedier reloading operation than that possible with the previous military pouch. Furthermore, there is a need for an improved pistol magazine holster which is more dressy than canvas and which will retain its dressy appearance even though subjected to a certain amount of wear and tear during usage.

It is an object of this invention to provide an improved holster for an automatic pistol magazine. It is another object of this invention to provide such an improved holster wherein the magazine is urged partly outside of the holster as soon as the cover is opened. It is yet another object to provide such an improved holster molded of a rigid material that is abrasion resistant. Still other objects will become more apparent to those skilled in the art upon reading the following description.

BRIEF SUMMARY OF THE INVENTION

This invention relates to a holster for an automatic pistol magazine which comprises a long rectangular rigid pouch with a closed lower end, an open upper end and an internal cavity, and a closeable cover, a magazine carrier which slides up and down in said internal cavity, and into which carrier slidingly and snugly fits the forward portion of said magazine, and a spring biased between the inside bottom of said holster and the outside bottom of said carrier to urge the rearward end of said magazine upward against said cover.

In preferred embodiments of the invention the holster may enclose a single magazine or two or more magazines, be an article molded from an abrasion-resistant plastic material, and have a flap cover with a permanent bend in the cover to make it be suspended over the open end when unfastened from the pouch.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 5 is a side elevational view of a prior art magazine for an automatic pistol which may be used in the holster of this invention;

FIG. 6 is a rear elevational view of the magazine of FIG. 5;

FIG. 10 is a front elevational view of a coil spring used in the holster of this invention;

FIG. 11 is a top plan view of the coil spring of FIG. 10; and

FIG. 12 is a perspective view of two holsters of this invention side-by-side showing one open and the other closed.

DETAILED DESCRIPTION OF THE INVENTION

The features of this invention are best understood by reference to the attached drawings.

Figure 1:
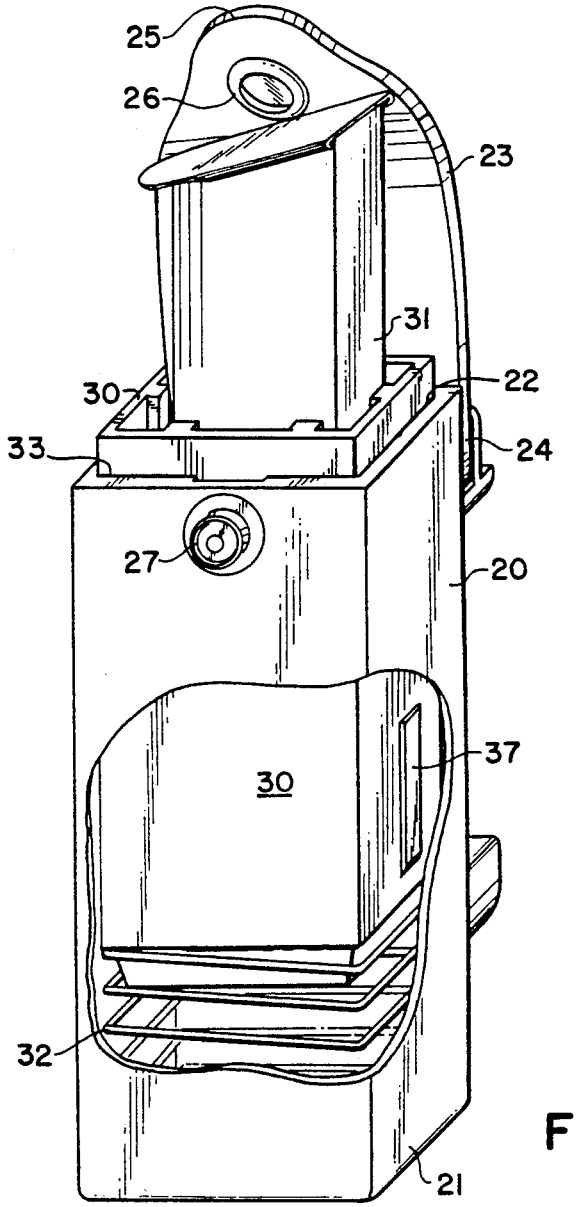
FIG. 1 is a perspective view of the holster of this invention.

In FIG. 1 there is shown the holster of this invention. The holster comprises three separate components; namely, the pouch 20, the magazine carrier 30, and the spring 32. This drawing also shows a magazine 31 which is intended to be carried in the holster of this invention, although the magazine 31 is well known in the prior art and is not, therefore, claimed as any part of this invention separate from the holster.

Pouch 20 is a rectangular box-like container generally elongated in the vertical direction and having four vertical walls, a closed bottom, an upper open end 22, an internal cavity 33, and a cover flap 23 to close over open end 22 when desired. Flap 23 is a stiffly flexible strip of leather or a leather-like material having one end 24 firmly attached to the back of pouch 20 by way of screws, rivets, adhesive or the like. Free end 25 of flap 23 has the female portion 26 of a snap fastener attached thereto which cooperates with the corresponding male portion 27 of the fastener, rigidly attached to the front side of pouch 20. Pouch 20 preferably is a molded plastic material having good abrasion-resistant properties. Such materials include polyolefins, polyacetals, polycarbonates, polyesters, phenolformaldehydes, urea-formaldehydes, and the like. Each vertical wall is covered with a thin sheet of leather 59 laminated to the wall to provide a quality leather appearance to the pouch 20. The vertical corners are not covered with leather panels 59 so as to take advantage of the wear-resistant properties of the plastic in preventing wear damage from auto seat belts and the like to mar the outer appearance of pouch 20. Panels 59 may be made of Porvaire or other leather-like materials. Flap cover 23 is also leather or a leather-like substitute that can be heat- or pressure-set to be given a permanent bend causing free end 25 to overhang open end 22 when fastener portions 26 and 27 are not engaged. Laminated leather material, such as that disclosed in U.S. Pat. No. 4,340,437 is suitable for this purpose.

Inside of pouch 20 in cavity 33 is a sliding magazine carrier 30 in which magazine 31 is carried. Spring 32 is compressed between the closed lower end 42 of carrier 30 and the inside closed bottom 21 of pouch 20 biased to urge carrier 30 upward toward open end 22. FIG. 1 shows the extent to which magazine 31 and carrier 30 project upwardly and out of pouch 20 when snap fastener 26/27 is opened allowing flap cover 23 to flex upwardly somewhat, and allow magazine 31 to be caught and stopped by the edge of female portion 26 of the snap fastener 26/27. It is desirable that magazine not fall out of pouch 20 until it is pulled out by the fingers of the one wearing the holster.

Figure 2:
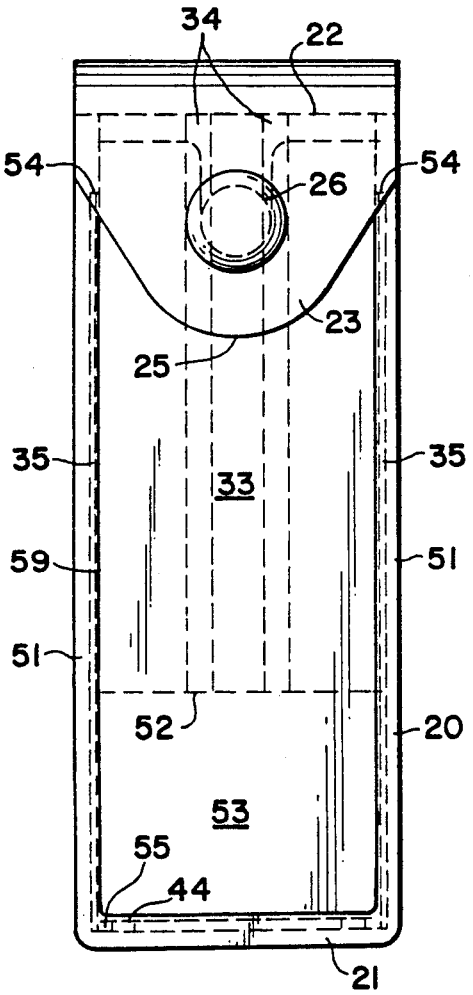
FIG. 2 is a front elevational view of the holster of this invention.
Figure 3:
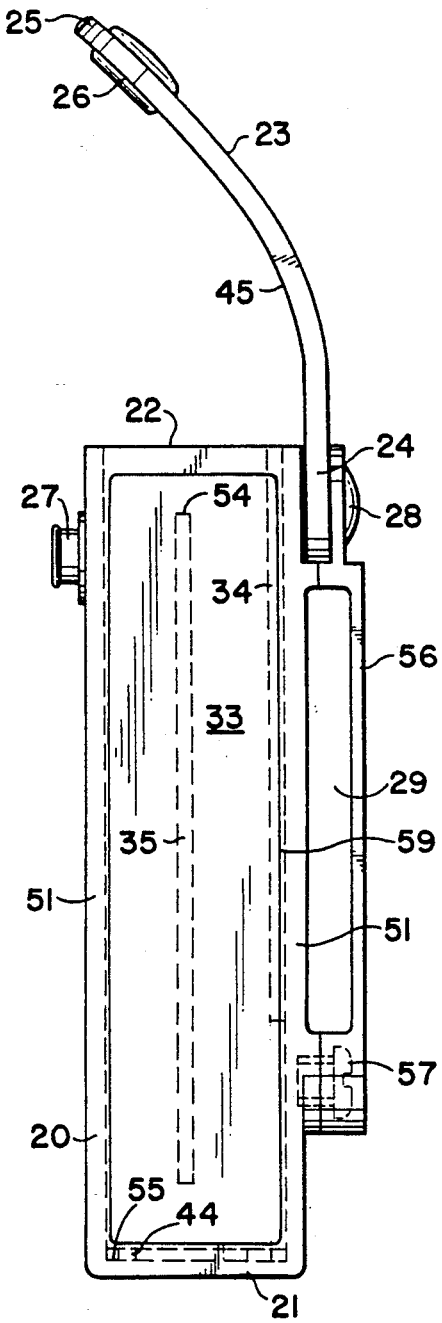
FIG. 3 is a side elevational view of the holster of this invention.
Figure 4:
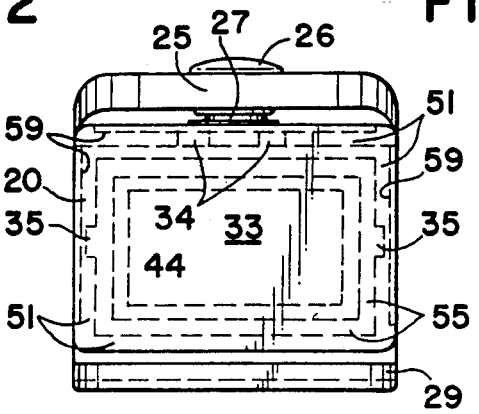
FIG. 4 is a bottom plan view of the holster of this invention.

In FIGS. 2–4 there are shown the details of pouch 20. The main body of pouch 20 is a rectangular open-top box having four vertical walls 51, a closed bottom 21 and an open top 22. Walls 51 are covered on the outside, except for the corners, with leather panels 59 which provide the desired appearance of the pouch being made of leather. Walls 51 are flat and unmodified except for two parallel grooves 35 and two parallel lands 34 in walls 51 which form guides from open end 22 to the upper end 52 of spring chamber 53. Lands 34 are small rectangular rails or guides in rear wall 51 which project inwardly into cavity 33 to reduce friction between the carrier 30 and pouch 20, and provide space for air to move into or out of cavity 33 as carrier 30 is moved upward or downward like a piston in a cylinder. Grooves 35 are recesses which receive lands 37 of carrier 30 (see FIGS. 7–9) and function as guides for the sliding movement of carrier 30 in pouch 20. Grooves 35 extend from about upper end 52 of spring chamber 53 to an upper end 54 short of, but close to, open end 22 of pouch 20. The inside bottom of pouch 20 is shown to be formed with a circumferential groove 55 around a raised annular base 44. This forms a seat in groove 55 for spring 32 (see FIGS. 10–11).

Pouch 20 is closed or opened by means of flap cover 23 having a fixed end 24 rigidly attached to pouch 20 by fastening means such as screws 28, rivets, adhesive, or the like. Flap 23 is leather or a leather-like material which is stiffly flexible and has a permanent bend heat-set or otherwise caused to be present in flap 23 as at 45. The bend is to cause flap 23, when fastener 26/27 is open to raise to about the position shown in FIG. 3 where it over-hangs open end 22, so that it will catch the upper end of magazine 30 (as seen at FIG. 1) and guide magazine 30 into female fastener portion 26 to stop magazine 30 from coming out of pouch 20. The wearer of the holster can easily force flap 23 to open further for easy removal of magazine 30. A fastening device of any type is affixed to free end 25 of flap 23; preferably female portion 26 of a snap fastener wherein the male portion 27 is on the front side of pouch 20.

On the back outside of pouch 20 is a belt loop locking piece 56 fastened to pouch 20 by screws 28 and 57 leaving an open space 29 for a belt to be passed through. Backing piece 56 may be fashioned in several sizes and shapes to produce different sizes and shapes of space 29 so as to fit whatever belt the wearer may desire.

FIGS. 5 and 6 show a prior art design of an automatic pistol magazine 31 having a forward end 46 from which bullets are dispensed in firing the pistol and a rearward end 47. Forward end 46 fits into carrier 30 with rearward end 47 extending upwardly and out of carrier toward open end 22. The carrier 30 must be designed to fit whatever magazine 31 is employed and with that modification the holster of this invention is useful for any and all types and designs of magazines.

Figure 8:
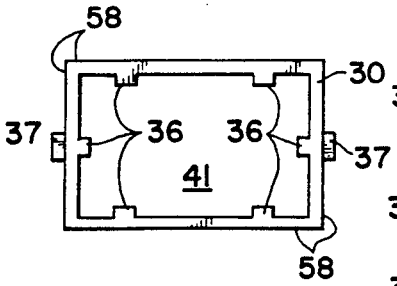
FIG. 8 is a top plan view of the magazine carrier of FIG. 7.
Figure 7:
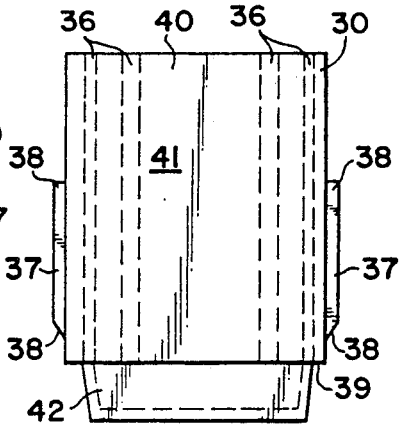
FIG. 7 is a front elevational view of the magazine carrier of this invention.
Figure 9:
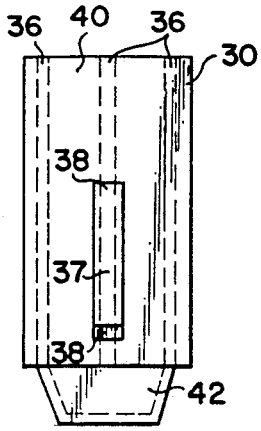
FIG. 9 is a side elevational view of the magazine of FIGS. 8 and 9.

FIGS. 7–9 show carrier 30 into which the forward end 46 of magazine 31 is pushed to obtain a snug fit. Only about the forward one-third of magazine 31 is contacted by carrier 30 while the remaining two-thirds extends upward beyond the upper edges of carrier 30. Carrier 30 is a rectangular box-like article with four vertical side walls 58, a closed bottom portion 42, an upper end 40 and an internal cavity 41. Lower closed end is tapered inwardly to fit forward end 46 of magazine 31 and for the outside to fit inside of coil spring 32. The inside of walls 58 contain a plurality (six shown here) of vertically or longitudinally running lands 36 which are sized and spaced to touch and guide the outside surfaces of magazine 31 into a snug fit with magazine 31 being manually slidable into and out of carrier 30. On two opposite walls 58 on the outside thereof are two lands 37 which engage corresponding grooves 35 on the inside of walls 51 of pouch 20. Carrier 30 moves upwardly and downwardly in its operations in the holster of this invention. When flap 23 is closed over the rearward end 47 of magazine 31 inside pouch 20, carrier 30 will be moved to its lower limit of travel, and, conversely, when flap 23 is open, carrier 30 will be moved to its upper limit of travel extending above open end 22 as shown in FIG. 1. The longitudinal length of land 37 and the extent of grooves 35 will determine these limits of travel. The ends 38 of lands 37 are tapered from the height of land 37 to a zero height above the outside surface of wall 58 so that carrier 30 may be manually inserted or removed from pouch by using enough force to cause walls 58 and 51 to flex sufficiently for that purpose. The choice of thickness of such walls and the inherent stiffness of the materials from which pouch 20 and carrier 30 are made will provide such flexibility. Carrier 30 preferably is made of a moldable plastic material such as those exemplified above with respect to pouch 20.

FIGS. 10–11 merely show a coil spring formed into a rectangular shape to fit the inside of pouch 20 and the annular groove seat 55 in the bottom of pouch 20. Carrier 30 is preferably formed with a ledge 39 separating the main body from the lower portion 42 of carrier 30. Ledge 39 forms a seat for the upper end of spring 32 which is in a compressed state while inside pouch 20 and under carrier 30 biased to expand and to lengthen when flap cover 23 is opened causing carrier 30 to move to its upper limit of travel above the open end 22 of pouch 20. When the cover 23 is closed and magazine 31 completely holstered the bottom wall of carrier 30 is very close to touching the inside of bottom 21 of pouch 20.

FIG. 12 shows two holsters side-by-side illustrating how one can be open and the other closed and yet provide easy access to the magazine 31 in the open holster without interference by the closed holster. If desired the two holsters could be combined into a single article of manufacture.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention

What is claimed as new and what it is desired to secure by Letters Patent of the United States is:

1. A holster for an automatic pistol magazine carrying a plurality of shells which comprises a long rectangular upright rigid hollow pouch having a closed bottom and an open upper end with a closeable top cover, a single magazine carrier having an open upper end and a closed lower end portion and which slides up and down within said hollow of said holster and into which slidingly and snugly fits an upper end portion of a single pistol magazine, and a coil spring means biased between an inside surface of said closed bottom of said pouch and said closed lower end portion of said magazine carrier to urge a downward end portion of a pistol magazine upward against said cover, said closed lower end portion having a bottom surface being positioned substantially in juxtaposition to said closed bottom of said pouch when a pistol magazine and said magazine carrier are fully holstered and said cover is closed, said magazine carrier extending outwardly of said pouch when said top cover is opened and being unremovable therefrom during normal use of said holster.

2. The holster of claim 1 wherein said lower end portion is pyramidally tapered to extend inside of said coil spring means to minimize the length of said pouch, said magazine carrier having a ledge above said bottom surface of said lower end portion forming a seat for said spring means.

3. The holster of claim 1 wherein said magazine carrier open upper end extends spacedly above said open upper end of said pouch when said cover is opened and said spring means has urged said magazine carrier upward to the full extent of its travel.

4. The holster of claim 1 wherein said pouch is made of a molded, abrasion-resistant plastic material and is inlaid with thin sheets of leather over substantially all of its outer surface except for the vertical and horizontal corners of said pouch.

5. The holster of claim 1 wherein said closeable top cover is a stiffly flexible leather-like flap fastened at one end thereof to said pouch adjacent said open end and the other end of the flap having thereon the female portion of a snap fastener for closing said top cover.

6. The holster of claim 5 wherein said flap is fashioned with a permanent bend in it so as to overhang said open end of said pouch when unfastened and to cause said female portion to function as a stop in preventing a magazine of an automatic pistol from moving too far out of said holster.

7. The holster of claim 6 wherein said pouch includes a male portion of said snap fastener to cooperate with said female portion on said flap cover.

8. The holster of claim 1 wherein said pouch includes two longitudinal grooves on opposite internal walls which cooperate with two outwardly projecting lands on outside walls of said carrier to guide the longitudinal sliding movement of said carrier in said pouch.

9. The holster of claim 8 wherein said grooves terminate adjacently below said open end, and said lands have lower ends that are tapered from their full heights to respective said outside walls of said carrier to permit insertion of said carrier into said rigid pouch.

10. The holster of claim 1 wherein said pouch includes a rearwardly disposed passageway for receiving a belt of a user.

11. The holster of claim 1 wherein said carrier additionally includes a plurality of laterally spaced longitudinal lands projecting inwardly from the opposing inside surfaces of said carrier, the dimensions between opposing lands being substantially identical to the corresponding outside dimensions of said magazine.

12. The holster of claim 1 which additionally includes a plurality of laterally spaced longitudinal lands projecting inwardly from one inside wall of said rigid pouch, the dimension from said lands to the opposite inside wall of said pouch being substantially the same as the corresponding outside dimension of said carrier.

13. A holster for a magazine carrying a plurality of shells of an automatic pistol and adapted to be attachable to a waist belt, said holster comprising an elongated rectangular box-like rigid upright pouch of four vertical walls, a closed bottom, and an open upper end with a stiffly flexible flap cover for closing said open end and attached at one end thereof to said pouch while the other end is free and has affixed thereto the female portion of a snap fastener cooperating with the corresponding male portion of said snap fastener affixed to said pouch adjacent said open end; a single magazine carrier longitudinally slidable inside said pouch and having a closed lower end and an open upper end, and an inside cavity of such dimensions that it will snugly receive the forward portion of a single magazine of an automatic pistol; and a coil spring positioned inside said pouch between said closed bottom of said pouch and a laterally extending ledge around the outside of said closed lower end of said carrier and being spaced upwardly from its lower end extremity, said spring being biased to push said carrier upward and partially outward of said open upper end of said pouch to expose above said open upper end of said magazine carrier a substantial length of a magazine of an automatic pistol when said flap cover is unfastened.

14. The holster of claim 13 wherein said pouch includes a plurality of longitudinal lands projecting inwardly and forming guides upon which said carrier slides longitudinally.

15. The holster of claim 13 wherein said carrier includes a plurality of spaced longitudinal lands projecting inwardly into said inside cavity and adapted to function as guides for directing the sliding of a magazine into and out of said carrier.

16. The holster of claim 13 wherein said flap cover is fashioned with a permanent bend therein to cause said flap when said snap fastener is open, to overhang said open end so as to form a stop means to prevent a magazine of an automatic pistol from becoming unintentionally separated from said carrier.

17. The holster of claim 13 wherein said pouch is a molded, abrasion-resistant plastic article with the outside surfaces of said walls covered with thin sheets of leather-like material except for the rounded corners at the intersection of said vertical walls.

18. A holster for an automatic pistol magazine carrying a plurality of shells which comprises a long rectangular upright rigid hollow pouch having a bottom end and an open upper end with a closeable top cover, a magazine carrier having an outer side wall surface and a reduced lower end portion in which a magazine is adapted to be received and extending inwardly from said outer wall surface, said carrier being positioned to slide up and down inside said holster and into which slidingly and snugly fits a downward portion of a single automatic pistol magazine, spring means biased between said bottom of said pouch and extending upwardly to engage said magazine carrier to urge said magazine carrier and an automatic pistol magazine carried therein upward against said cover, said spring means engaging said carrier outwardly of said reduced lower end outer surface portion spacedly upwardly from a lower planar surface of said reduced lower end outer surface portion, said lower planar surface being substantially juxtaposed with said bottom end of said pouch when said spring means is fully compressed, and said reduced lower end portion being located within said fully compressed spring means, and means attached to said pouch for attaching said holster to a belt of a user.

19. The holster of claim 18 wherein said closeable top cover is a stiffly flexible leather-like flap removably fastened at one end thereof to said pouch adjacent said open end and another end of said flap having a quick-release fastener for closing said cover over said open end of said pouch, said flap being replaceable to accommodate for longer or shorter automatic pistol magazines.

20. The holster of claim 18 wherein said pouch is made of a molded, abrasion-resistant plastic material, said pouch having a front and side vertical walls with rectangular cavities formed therein, a plurality of thin panels of leather-like material filling said cavities and being flush with outer surfaces of said plastic material of said pouch.

* * * * *